US006495018B1

(12) United States Patent
Lowe

(10) Patent No.: US 6,495,018 B1
(45) Date of Patent: Dec. 17, 2002

(54) ELECTRO-PLATING APPARATUS AND METHOD

(75) Inventor: John Michael Lowe, Market Harborough (GB)

(73) Assignee: Technology Development Associate Operations Limited, Leicestershire (GB)

( * ) Notice: Subject to any disclaimer, the term of this patent is extended or adjusted under 35 U.S.C. 154(b) by 0 days.

(21) Appl. No.: 09/525,586

(22) Filed: Mar. 15, 2000

(30) Foreign Application Priority Data

Mar. 18, 2000 (GB) ..... 0005886

(51) Int. Cl.[7] ..... C25D 21/12; C25D 5/16; C25D 17/00

(52) U.S. Cl. ..... 205/83; 205/81; 205/82; 205/95; 205/97; 205/137; 204/228.1; 204/229.8; 204/230.2

(58) Field of Search ..... 205/81, 82, 83, 205/84, 95, 96, 97, 137; 204/228.1, 298.23, 224 R, 225, 229.8, 230.2

(56) References Cited

U.S. PATENT DOCUMENTS 4,304,641 A * 12/1981 Grandia et al. ..... 204/23
5,156,730 A * 10/1992 Bhatt et al. ..... 205/118
6,159,354 A * 12/2000 Contolini et al. ..... 205/96

* cited by examiner

*Primary Examiner*—Robert Dawson
*Assistant Examiner*—Michael J Feely
(74) *Attorney, Agent, or Firm*—Jones, Walker, Waechter, Poitevent, Carrere & Denegre, L.L.P.

(57) ABSTRACT

A single delivery channel is formed by, and between, inner wall 2 and baffle 3. Electrolyte 5 is pumped up the interior of channel 1 and is directed onto substrate 4 being a cathode maintained at −10 volts. The upper part of the inner wall 2 of channel 1 forms the anode such that electrote is forced between the substrate and the upper horizontal surface of the anode 6. A second baffle 7 is provided in order to assist in collecting and removing electrolyte 5 after impingement with substrate 4, possible for re-use. Contact between the electrolyte 5 and substrate 4 is optimised by providing the electrolyte with a swirling motion as it passes up channel 1. Anode 6 is a solid conducting bar 10, alternatively it is formed of solid rods 11 nor tubes 12.

29 Claims, 9 Drawing Sheets

ELECTRO-PLATING APPARATUS AND METHOD

This application is claiming priority to Great Britain Patent application No. 0005886.7 filed Mar. 13, 2000.

The present invention relates to apparatus for electro-plating and to a method of electro-plating.

A major problem associated with electro-plating, especially when high deposition rates are attempted, is the irregularity of deposition.

Another major problem is the need for all areas that are to be plated to be electrically connected.

To obtain a uniform plating deposit using existing methods, the required situation is that given by two parallel, co-axial and equi-potential conducting planes separated by a medium of homogenous resistance. If a potential difference exists between the two planes, then the current will flow between and normal to the two planes with uniform density (see FIG. 1). If the medium separating the two planes is an electrolyte of suitable composition containing adequate, and suitable ions of the material to be deposited, then a uniform deposition of the material will be made on the plane which is at the more negative potential. The amount of the deposit is dependent upon the material type and the total electrical charge.

In practice, the situation described above does not occur, due to surface roughness of the two planes and the lack of homogeneity of the electrolyte. Also, practical difficulties, associated with achieving true parallelism of the planes and the possible irregular pattern of the conductive surface of the negative (target) plane and the restrictions of the electrolyte flow, to some or all of the target plane surface, add to the lack of uniformity of the current density within the electrolyte. This results in irregular deposits of material on the target surface.

Figure 1:
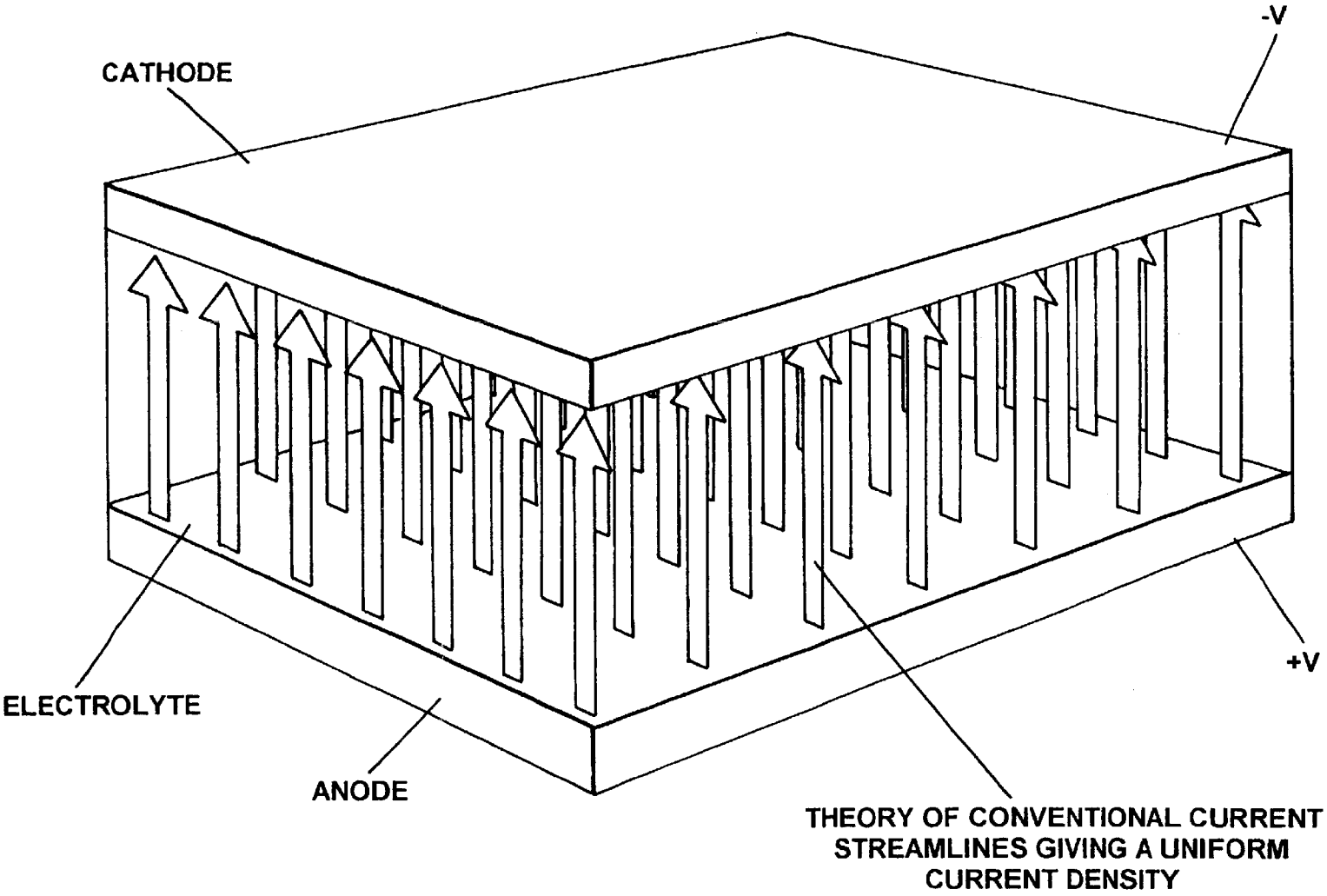

Several techniques have been employed to offset these effects including the use of current diversions (robber bars) at the target surface. Such techniques are only partially successful and are inherently inefficient. There are few, if any, practical techniques for dealing with situations in which the target surface has areas which are to be plated but which are not electrically connected.

The present invention comprises electro-plating apparatus having means to direct electrolyte to a target, and means to control the amount of reduction, and/or rate thereof, of ions in the selected regions of the target.

The electro-plating apparatus may comprise means to monitor the current flow in some or all regions of the target.

The electro-plating apparatus may comprise means to regulate the current flow to each region so that the material deposition rate for each region may be independently varied.

The direction as may comprise a hollow, elongate, body along the interior of which electrolyte passes (e.g. by pumping, or other pressurising methods, or other methods for inducing flow) for exit through an outlet and towards a target being a substrate maintained at a negative voltage relative to part of the body, whereby the target forms a cathode and the part of the body forms an anode. The anode part of the body may be formed of a single element or of a plurality of electrically isolated elements or rods. In a particular, advantageous embodiment, the direction means comprises a plurality of hollow tubes for the flow of electrolyte along the interior of the tubes and towards the target.

Electro-plating apparatus may include any one or more of the following features:

- the control means comprises means to regulate the current applied to each of a plurality of separate regions of the target.
- the control means comprises means to regulate the size and/or duration of current applied to each of a plurality of separate regions of the target.
- the control means comprises means to measure the current flowing to a region of the target and means to control the current applied to that region in dependence on the output of the measurement means.
- control means operable to provide a reduction layer of uniform thickness on the target.
- control means operable to provide a reduction layer on the target wherein different regions have predetermined reduction thicknesses.
- control means operable to provide a target with a uniform reduction thickness in selected regions.
- the control means comprises means to control the current flow to each region so that the ion reduction rate for each region may be independently varied.
- the control means comprises means to monitor the current flow in all regions of the target.
- the direction means comprises a hollow, elongate body for the passage of electrolyte along the interior of the body.
- a single element anode.
- an anode formed of a plurality of generally parallel solid rods.
- an anode formed of a plurality of generally parallel tubes through which electrolyte passes.
- means to effect swirling of the electrolyte in the vicinity of contact with the target.
- swirling means comprises shaping of the body and/or the outlet such that the vortices are created or enhanced.
- serrations in the leading edge of the anode.

The electro-plating apparatus may comprise means to effect movement of the electrolyte in the region of contact with the target, thereby to enhance impingement between electrolyte and target to optimise ion availability. In one embodiment, the shape of the body and the outlet are such that swirling is created or enhanced, typically by the inclusion of serrations in the leading edge of the anode.

The present invention comprises a method of electro-plating comprising directing electrolyte to a target and controlling the amount of deposition, and/or rate thereof, of material in selected regions of the target.

The method may comprise monitoring the current flow in some or all regions of the target.

The method may comprise regulating the current flow to each region so that the material deposition rate for each region may be independently varied.

The method may comprise effecting movement of the electrolyte in the region of contact with the target, thereby to enhance impingement between electrolyte and target to optimise ion availability. In one embodiment, the shape of the body and the outlet are such that swirling is created or enhanced, typically by the inclusion of serrations in the leading edge of the anode.

The present invention also provides a computer program product directly loadable into the internal memory of a digital computer, comprising software code portions for performing the steps of a method according to the present invention, when said product is ran on a computer.

The present invention also provides a computer program product stored on a computer useable medium, comprising:

computer readable program means for causing the computer to control the amount of deposition, and/or rate thereof, of material in selected regions of the target.

The present invention also provides electronic distribution of a computer program as defined in the present invention.

Figure 2:
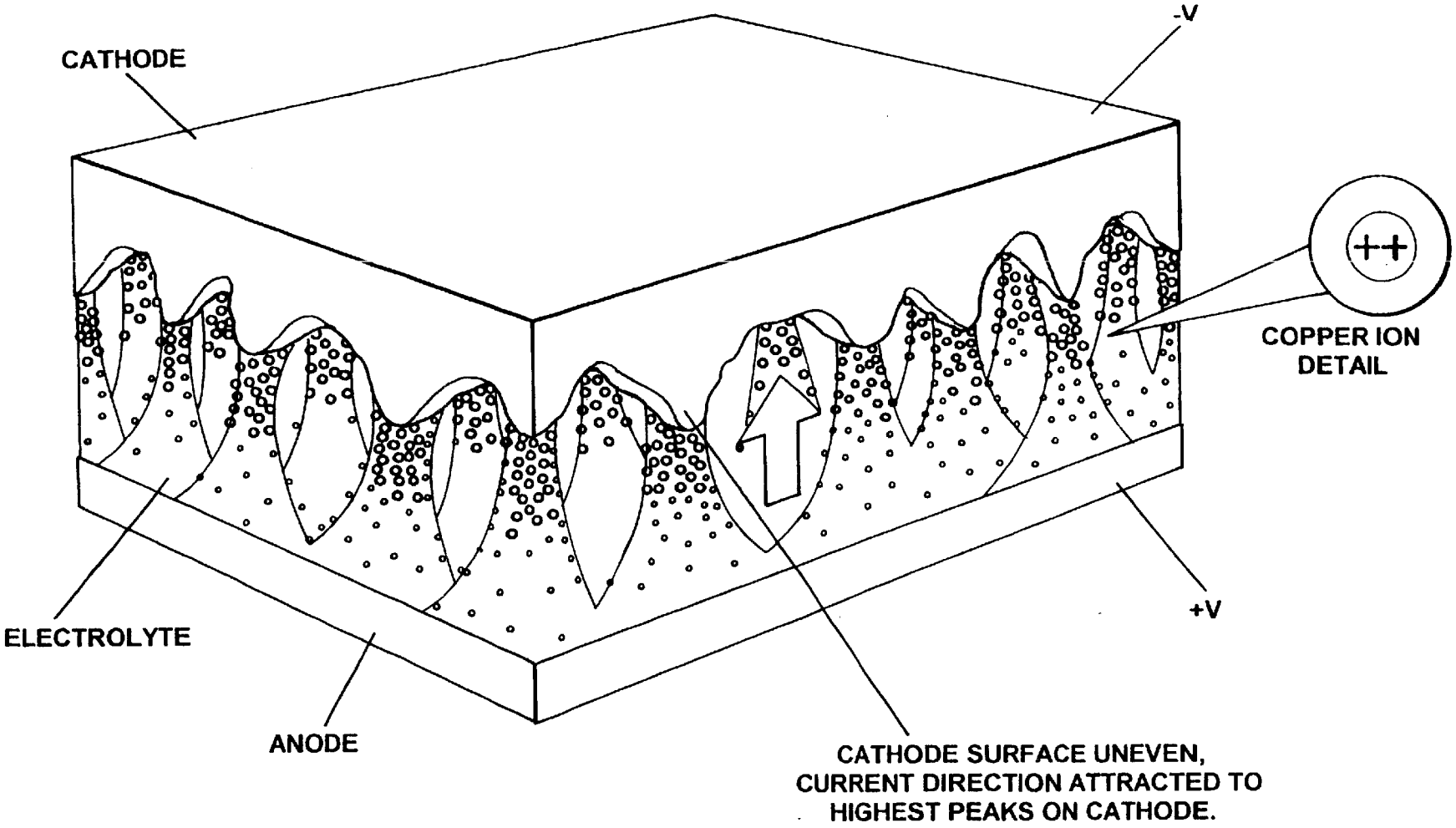
FIG. 2 shows the distortion of the current stream, and therefore current density distribution, due to the irregularity of the target (negative) surface. Further distortions due to the irregularities in the positive surface and variations in the electrolyte resistance are not shown.
Figure 3:
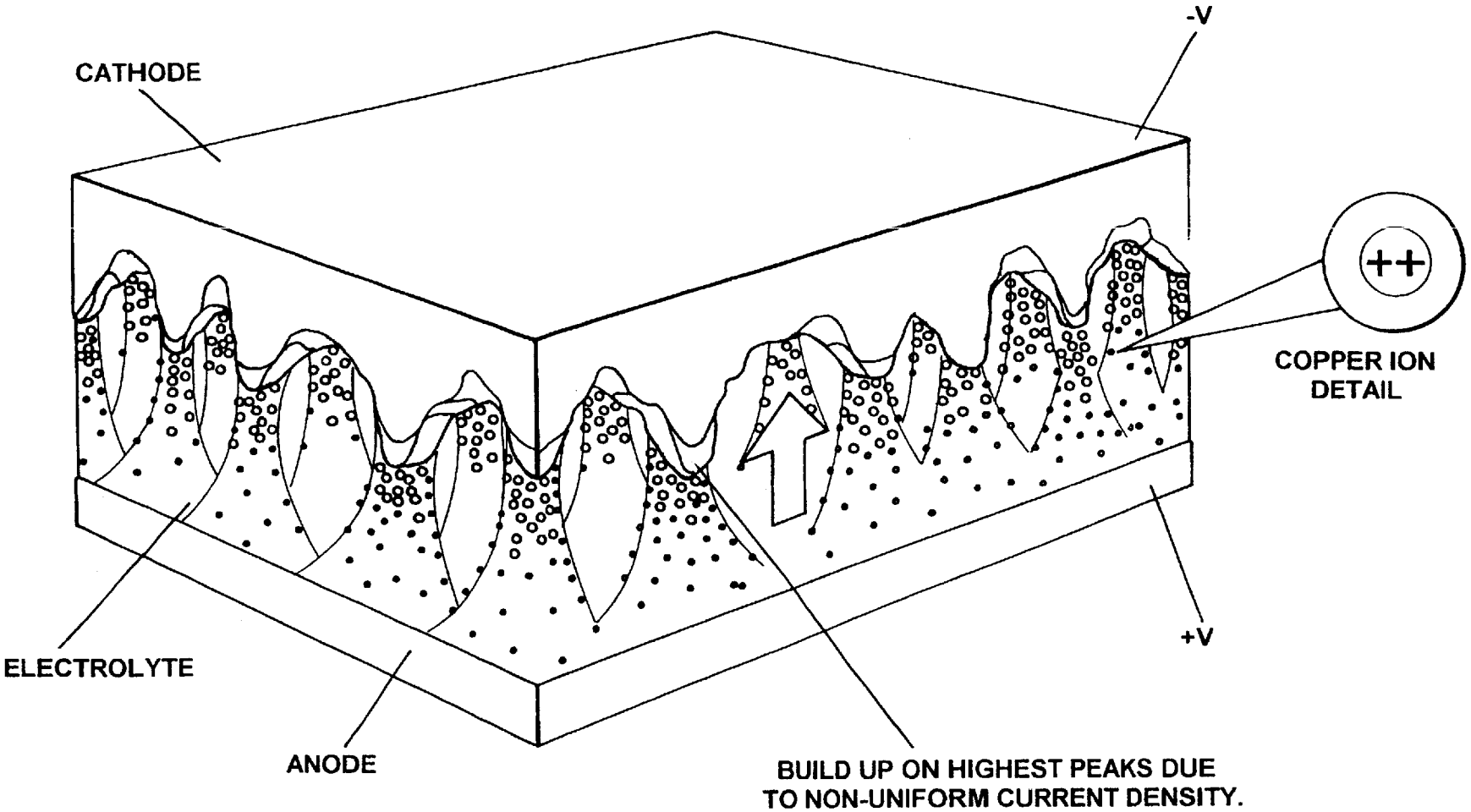
FIG. 3 shows the accentuation of the irregularities in the target surface due to the unequal current density distribution. The interaction of unequal current density and surface irregularity can be seen to be mutually progressive.
Figure 4:
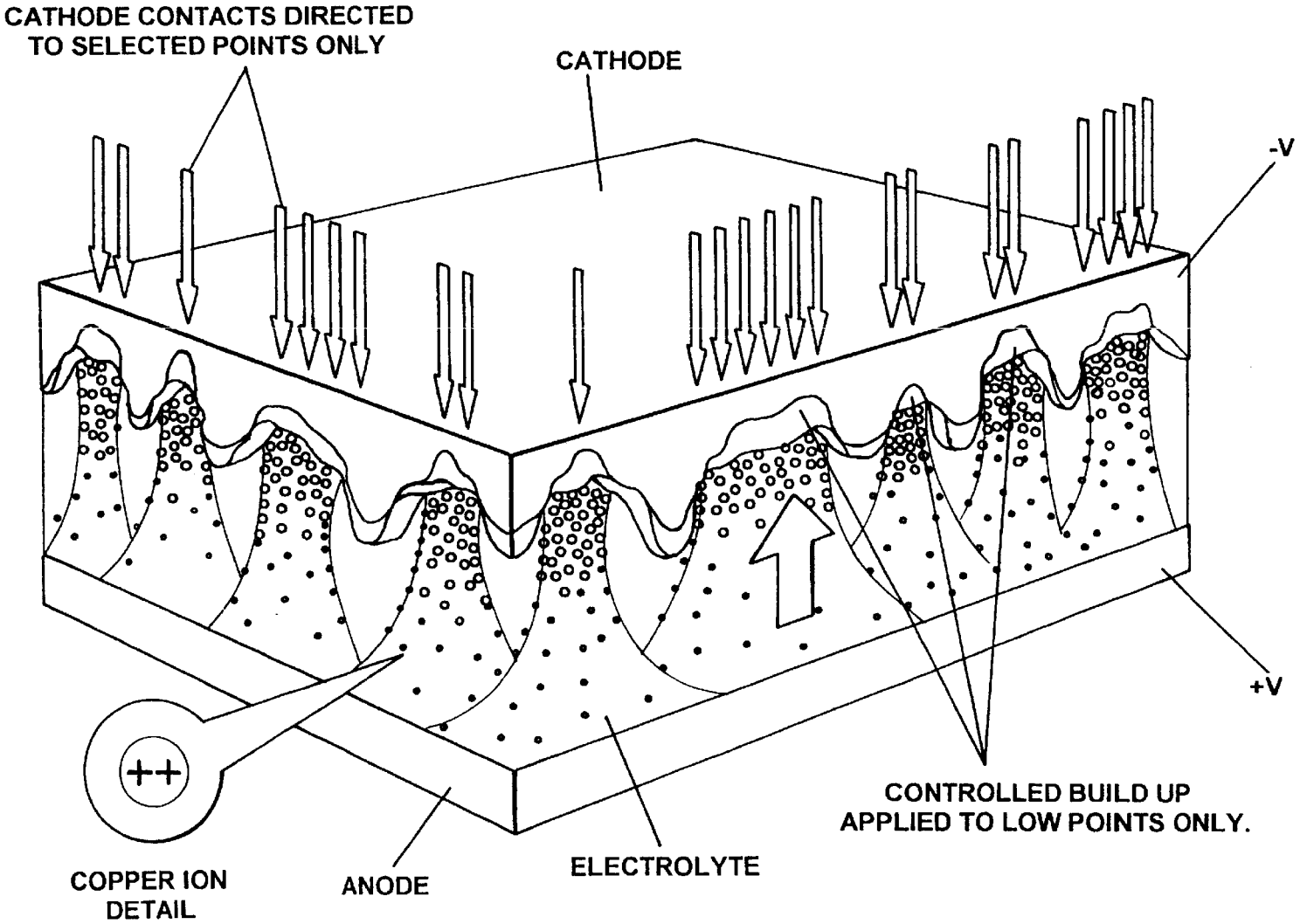
Figure 5:
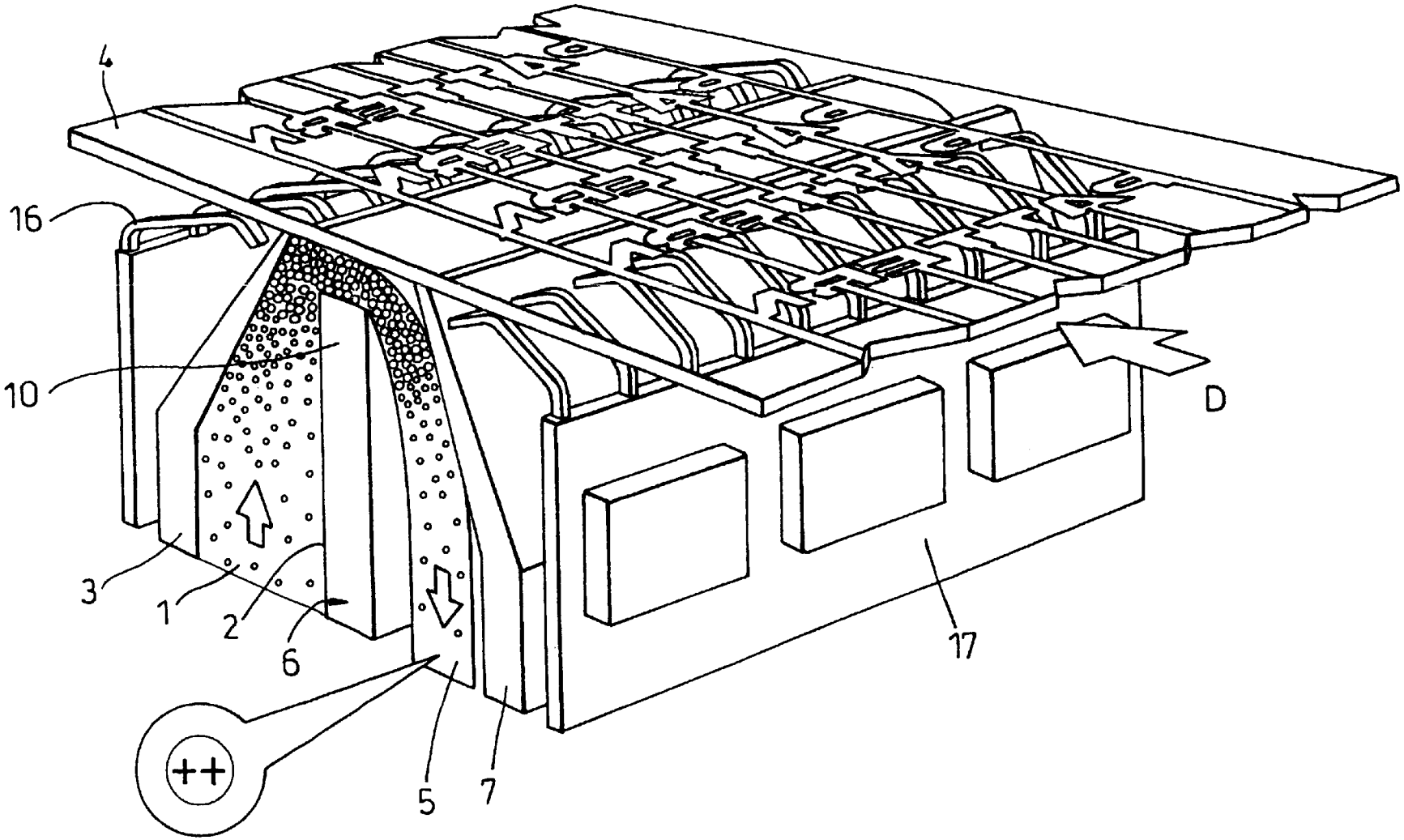
Figure 6:
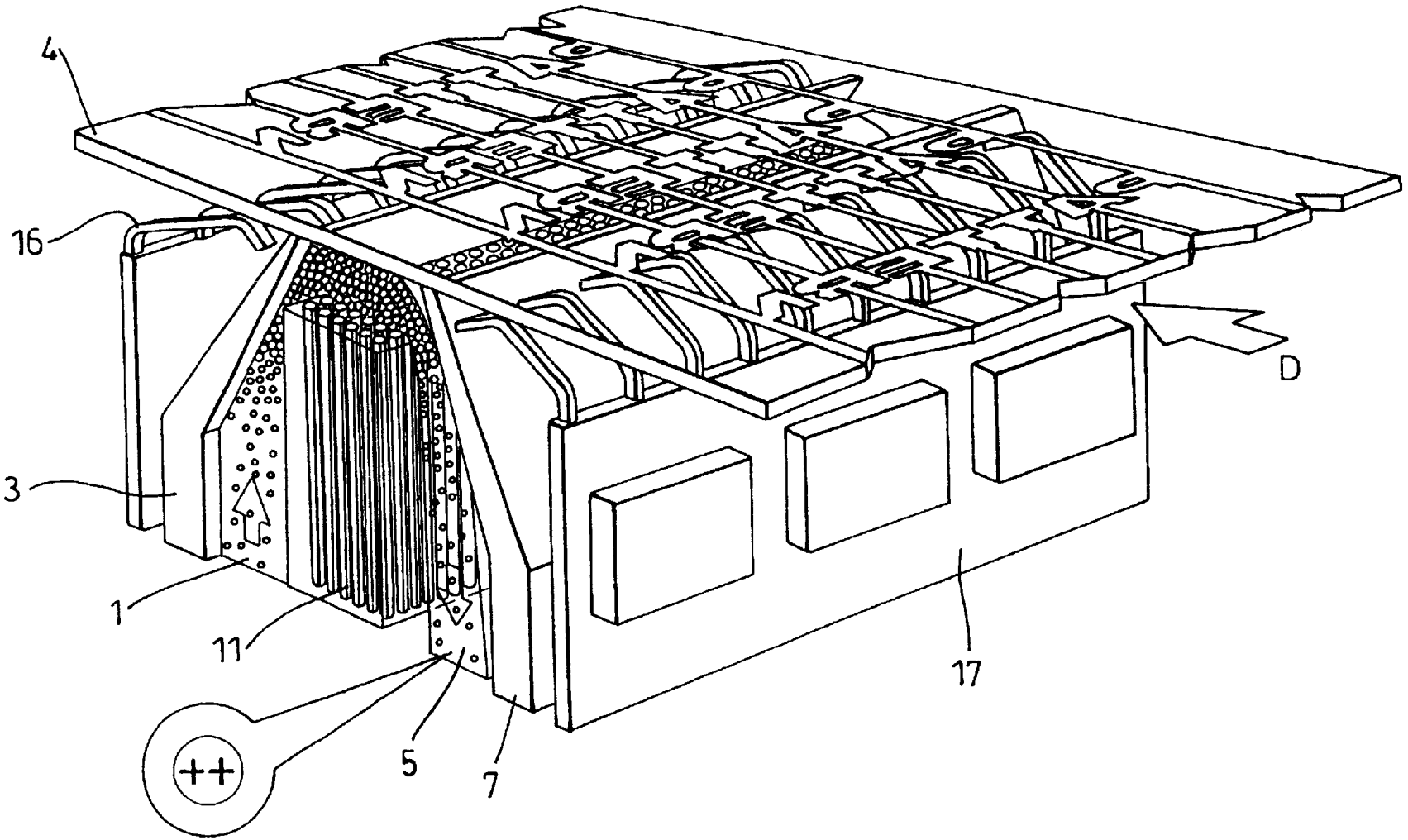
Figure 7:
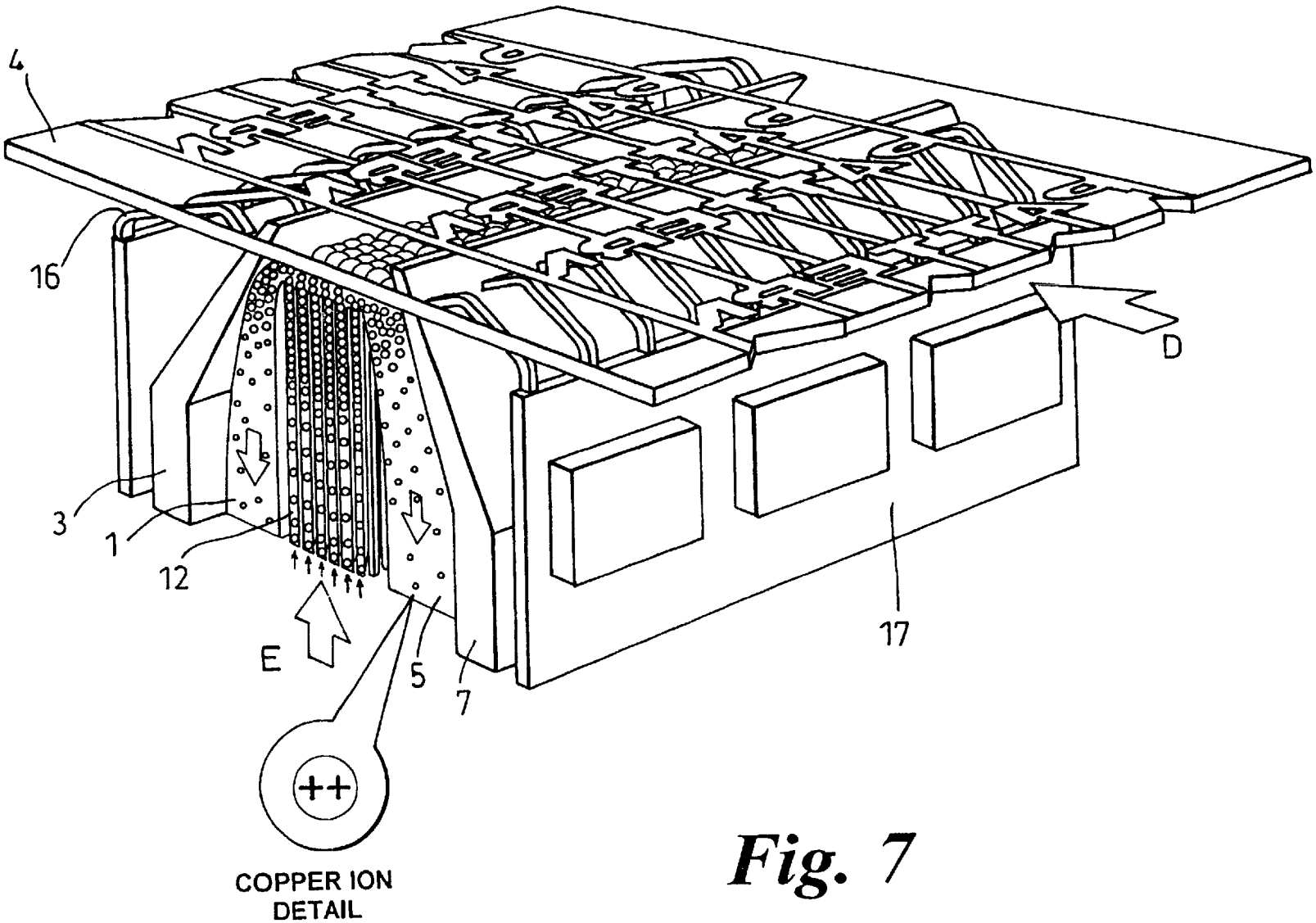
Figure 8:
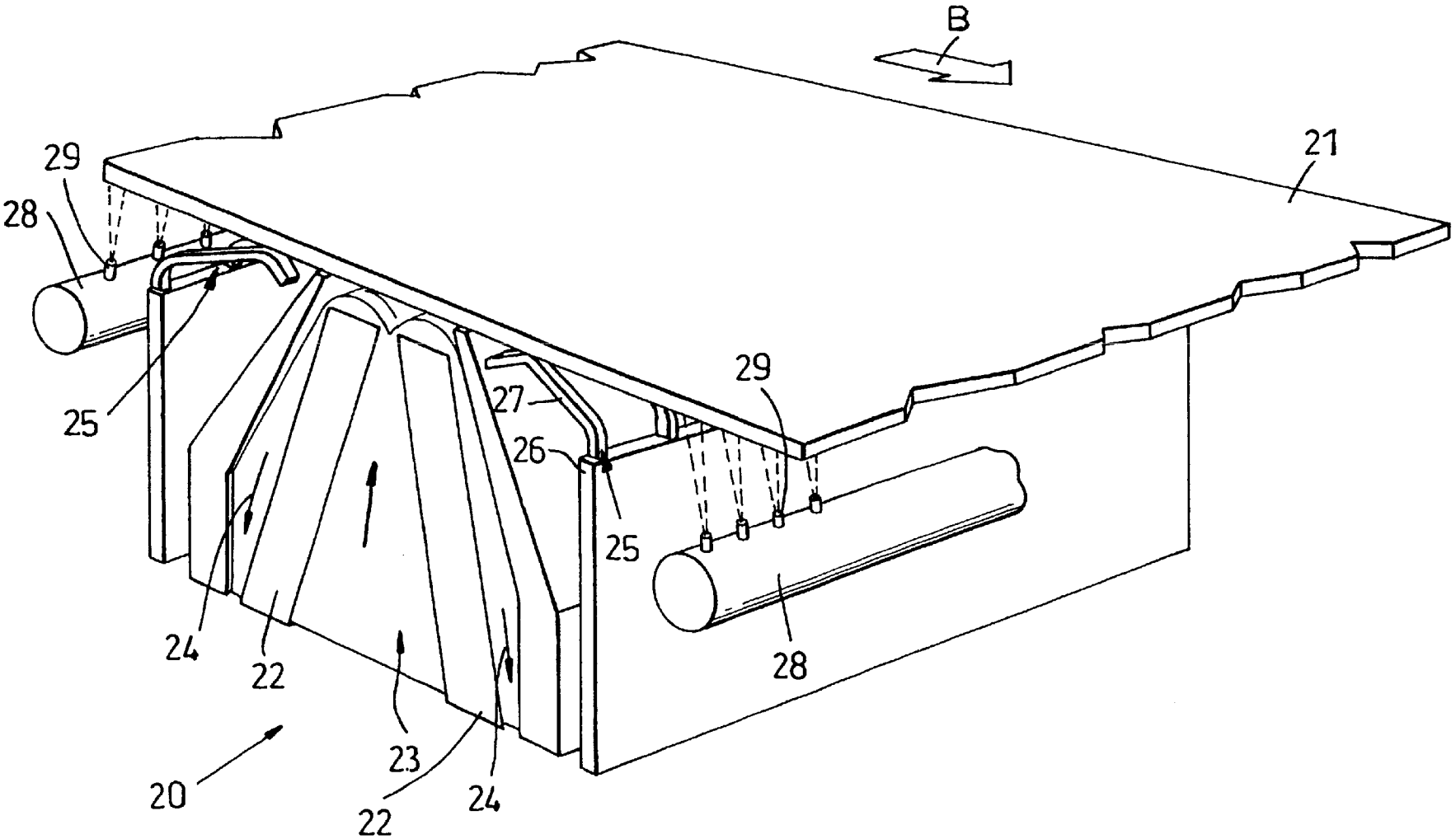

In order that the invention may more readily be understood, a description is now given, by way of example only, reference being made to the accompanying drawings, in which:

FIG. 1 is a schematic view of the idealised current flow between two conducting planes;

FIG. 2 is a schematic view of the actual current flow between two conducting planes with surface irregularities;

FIG. 3 is a schematic view of the peak build-up between two conducting planes;

FIG. 4 is a schematic view of a current control solution between two conducting planes with surface irregularities;

FIG. 5 is a schematic view of the present invention;

FIG. 6 is a schematic view of another form of the present invention;

FIG. 7 is a schematic view of another form of the present invention;

FIG. 8 is a schematic view of another form of the present invention; and

Figure 9:
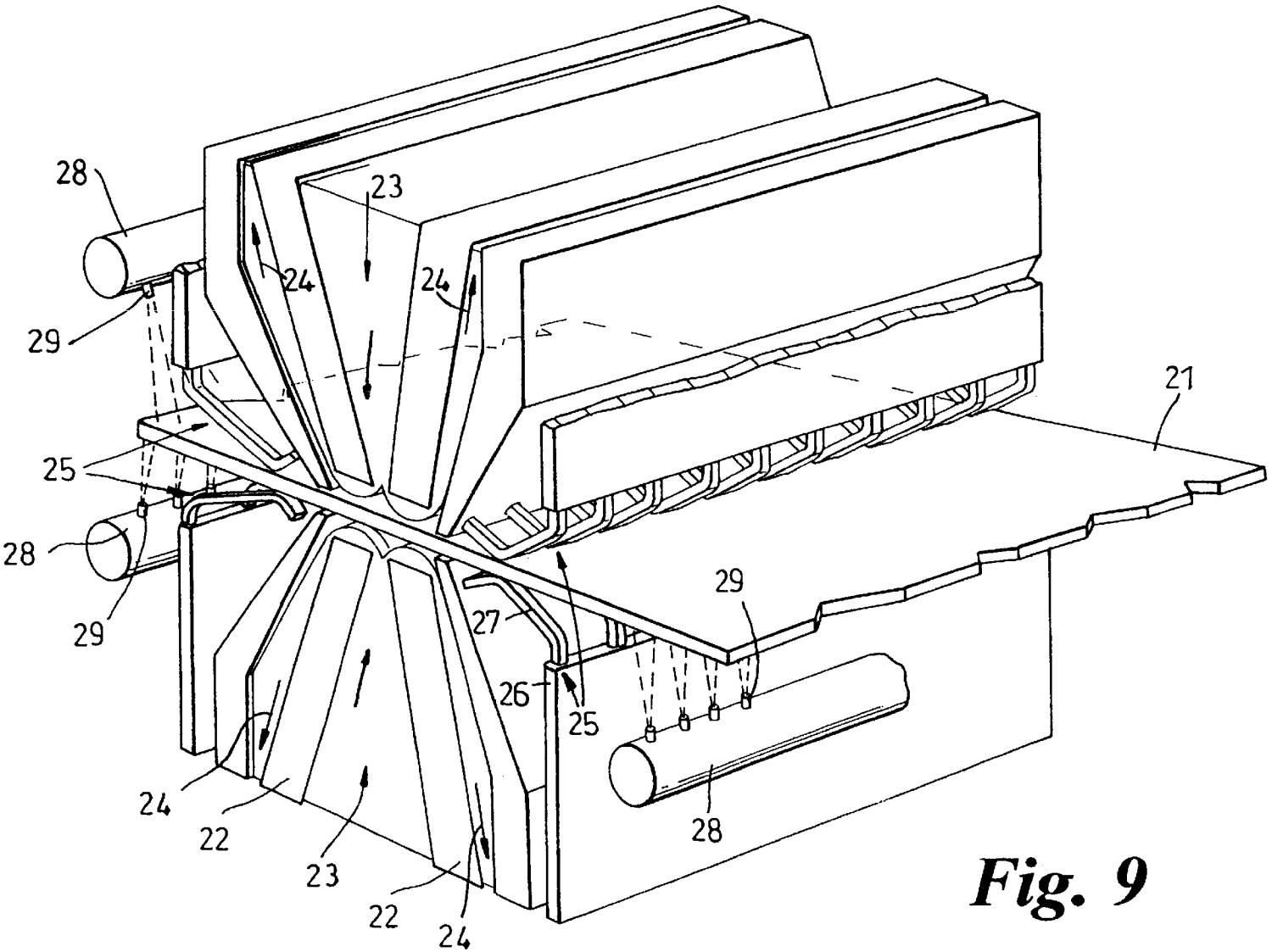

FIG. 9 is a schematic view of a variant of FIG. 8.

A uniform electroplated deposit requires the same amount of current to flow into each unit area of the target The smaller the unit area, the better the resolution of surface finish a s a function of the finish before the start of deposition. The availability of suitable ions at the surface of each unit area of the target must be sufficient to support the selected deposition rate.

A method of achieving these requirements and correcting for initial irregularities is shown in FIG. 4. For the purpose of clarity, only one row and column of electrodes is shown and, of these, only those that are active to correct the given irregularity situation are shown.

In reality, the method of contacting the opposite face of the cathode with the electrode array is practical only in situations where there is no non-conducting backing or substrate used to support the cathode material.

A method for dealing with situations where there is non-conducting substrate is shown in FIG. 5. In FIG. 5 as the pattern on the transparent substrate 4 passes over the anode and electrolyte solution, it becomes the cathode. Arrow D shows the direction of substrate material flow. Negative electrodes 16 (otherwise known as cathode connectors) are typically 0.5 mm wide on 1 mm pitch and attached to printed circuit board 17.

In FIGS. 4 and 5, each unit area of the target surface is connected to the more negative potential by its own independent electrode. The current in each electrode is controlled by, typically, electronic means so that each unit area receives the same charge.

A supply of electrolyte is caused to flow between the anode and the target surface in such a manner that the hydrostatic, diffusion and other barrier layers do not prevent suitable ions being presented to the target surface at a rate, preferably, much greater than that required by the set current density.

The geometry of the apparatus, together with the electrolyte formulation, the current density and the speed with which the target surface is passed through the mechanism, are major factors which define the rate of reduction.

The embodiment of the present invention illustrated with reference to FIG. 5 comprises a single delivery channel 1 formed by, and between, inner wall 2 and baffle 3, channel 1 having dimensions of 100 mm height, 1 meter width (i.e. extending across the width of the substrate 4) and 20 mm end length (i.e. extending along the length of the substrate 4). Electrolyte 5 is pumped up the interior of channel 1 and is directed onto substrate 4 being a cathode maintained at −10 volts with respect to the anode, although potential differences between cathode and anode as small as 2.5 volts have been successfully employed. The upper part of the inner wall 2 of channel 1 forms the anode such that electrolyte is forced between the substrate and the upper horizontal surface of the anode 6. A second is baffle 7 is provided in order to assist in collecting and removing electrolyte 5 after impingement with substrate 4, possibly for re-use.

Contact between the electrolyte 5 and substrate 4 is optimised by providing the electrolyte with a swirling motion as it passes up channel 1, thereby enhancing the creation of vortices upon impingement of the stream with the substrate to increase the reduction rate.

The apparatus described in FIG. 5 has demonstrated linear deposition using current densities being two orders of magnitude greater than those considered a maximum in conventional electro-plating technologies.

The proximity of the anode 6 to the substrate 4 and the resulting short current path of typically 1 or 2 mm together with the availability of suitable ions at the substrate surface gives a much more uniform current flow per unit area of the substrate surface compared to systems with longer current paths through the electrolyte 5. The distance from the negative electrodes to the electrolyte relative to the distance between adjacent negative electrodes defines the resolution of differential current control for arrangements shown in FIG. 4 and FIG. 5.

The embodiment of the present invention illustrated with reference to FIG. 5 comprises an anode 6 being a solid conducting bar 10 of dimension 1 meter width, 100 mm high and 20 mm end length. In the embodiment of FIG. 6, the anode is formed of a number (only twelve shown) of solid conducting rods 11 of diameter 3 mm and height 30 mm parallel to one another and arranged in a two dimensional grid structure, with a separation between their peripheries of about 1 mm, or otherwise arranged geometrically to one another so as to maximise speedy and accurate ion impingement and material deposition and maintaining the required current control features.

In the embodiment of FIG. 7, the anode is formed of a number of capillary delivery tubes 12 of external diameter 3 mm, internal diameter 1 mm and height 30 mm parallel to one another and arranged in a two dimensional grid structure across the width of the substrate being 1 meter, tubes 12 having a separation between their peripheries of 1 mm. Electrolyte 5 is pumped past the bar 10 (in FIG. 5) or the rods 11 (in FIG. 6), or up within the tubes 12 (in FIG. 7) and directed onto a target surface of substrate 4 forming a cathode. Bar 10, rods 11 or tubes 12 as appropriate form an anode maintained at +10 volts with respect to the cathode. A baffle 7 is provided at the exit of the channel 1 in order to assist in collecting and removing electrolyte 5 after impingement with substrate 4, possibly for re-use.

More specifically, FIG. 6 shows an electroplating apparatus in which the anode consists of multiplicity of separate rods 11 encased in plastic, each having the current flowing in it monitored and controlled in a similar manner to that previously described for the negative electrodes. Because the upper surface of the anodes is relatively close to the surface on which the ion reduction is to be made, and therefore the path of the current from each anode segment to the cathode is shorter, or may be made shorter, than the distance between the axes or horizontal spacing of the anode segments, the resolution of areas of differential current control is much improved with respect to that available from the arrangement of FIGS. 3, 4 and 5.

Because current monitoring and regulation may be performed in the anode element circuits in the method shown in FIG. 6, the monitoring and control of current in the negative electrodes is no longer essential. Situations may arise, where to achieve the optimum ion reduction resolution, both anode and negative electrode current monitoring and control may be employed. However, the major function of the negative electrodes in the method shown in FIG. 6 is to provide electrical connection between the negative potential and the features onto which ion reduction is to be made. The geometry of the negative electrodes with respect to the anodes and electrolyte defines the resolution of the feature size onto which ion reduction may be made. The multiple anode system and the associated factors controlling ion reduction and features resolution are equally applicable to applications where there is no substrate or a conducting substrate and the negative electrodes may be contacted to the opposite side of the substrate or cathode to that onto which ion reduction is required.

FIG. 7 shows a further development of the composite anode system of FIG. 6. In this case, the anode rods are in the form of hollow tubes and the electrolyte is delivered through the tubes en route to the deposition surface in the direction of arrow E. The hollow anode principle may be more simply realised by using two bars with the electrolyte caused to flow between them (see FIGS. 8 and 9). The hydrostatic barrier layer of the electrolyte 5 at the surface of the substrate 4 is dependent upon the velocity of the electrolyte in a direction parallel to the substrate plane. Therefore correct design of the electrolyte flow in this system gives further reduction of the various barrier layers compared to that achieved by the "swirling only" method. The reduction is caused by the initial flow of the electrolyte being normal to the substrate until the electrolyte strikes the substrate. The design of this system must inhibit the creation of any areas of stagnation of electrolyte at the substrate surface. Avoidance of stagnation may be achieved by the introduction of swirling.

To achieve the maximum resolution of differential current control with arrangements as shown in FIG. 5, the distance from the negative electrodes to the electrolyte relative to the distance between adjacent negative electrodes is as small as possible. Therefore, the arrangement shown in FIG. 5 requires both the distance from the negative electrodes' contact point to the electrolyte and the width of the electrolyte between the two sets of electrodes to be as small as possible.

The arrangements shown in FIGS. 6 and 7 do not have this restriction because the length of the controlled current paths are defined by the distance from substrate to anode and therefore allow for the use of anode structures which are larger in the dimension between the two sets of negative electrodes. This allows for faster transit times of the substrate or for greater ion reduction rates for the same transit time. The limitation of anode size, and therefore distance between the two sets of negative electrodes, is the minimum size of the features onto which material is to be deposited.

Where it is required to deposit material on features which do not allow for the use of negative electrode structures as shown in FIGS. 5, 6 and 7, the use of negative electrodes of the same shape as the anodes of FIG. 5 and intermingled with the anode array or the use of concentric anode-cathode rods/tubes may be employed. In both cases, the contact point of the negative electrodes to the substrate must be protected from the electrolyte either by de-ionised water stream, as used to protect the negative electrodes of FIGS. 5, 6 and 7 from electrolyte contamination, or by other suitable means.

The rods and tubes of FIGS. 6 and 7 are shown parallel. However in variants they are not parallel, for example they may be straight or curved with their upper ends closer together than the rest of them, and/or one or more of them may be in a spiral or helical form to impart a circulatory, swirling or vortex motion to the electrolyte.

The current in the (positive and/or negative) electrode associated with each region may be controlled by measuring the current flowing in each electrode, comparing this with a desired value and then increasing or decreasing the current to the desired value. The current flowing in each electrode may be quantified by measuring the voltage developed across a suitable resistor placed in the electrode circuit. The current flowing in each electrode circuit may be regulated by using analogue or digital techniques.

In situations where the pattern, on which material is to be deposited, is repetitive the current profile with time or distance of each electrode may be pre-programmed for optimum results. Each cycle of current profile may be initiated by a marker concurrent with or preceding each repetitive pattern.

FIG. 8 shows a simple hollow anode system with part of the electrolyte flow normal to the target surface.

FIG. 8 shows an electro-plating apparatus 20 for plating a rigid or flexible substrate 21. Apparatus 20 comprises a hollow anode 22 through the centre of which electrolyte 23 is directed onto a portion of substrate 21 moving in direction B and then removed along. side channels 24. Cathodes 25 are in the form of comb main portions 26 with teeth 27 to ensure that unconnected regions of substrate 21 are electrically connected to cathodes 25 before and after impingement of electrolyte 23 to ensure that there is adequate deposition of material onto all required parts of substrate 21.

Two cleaners 28 with nozzles 29 are provided to direct de-ionised water onto the substrate 20 before and after contact with cathodes 25.

FIG. 9 shows a variant of the apparatus of FIG. 8 but wherein both sides of substrate 21 are plated.

The anodes described above are of the non-sacrifical type and are made of a material which resists erosion to maintain the geometric integrity.

The electrolyte composition may be maintained by the addition of appropriate salts or by the use of secondary sacrificial anodes.

Whichever system is used, the power requirement is reduced compared to conventional methods due the close geometric relationship of the anodes(s) and the cathode.

What is claimed is:

1. An electro-plating apparatus comprising:

a. means to direct an electrolyte stream to a target, b. means to control the amount of reduction, and/or rate thereof, of ions in selected regions of said target, said control means comprising:

i. a means to measure the current flowing to said regions of said target, and ii. a means to control the current applied to said regions in dependence on an output of said measurement means, and c. a means to effect swirling of the electrolyte stream in the vicinity of said regions, thereby enhancing the creation of vortices upon impingement of the stream with the said regions in order to increase the ion reduction rate.

2. Apparatus according to claim 1 wherein said swirling means comprises a shaped body of said apparatus and/or an outlet of said electrolyte such that vortices are created or enhanced in said electrolyte.

3. Apparatus according to claim 1 wherein said swirling means further comprises serrations in the leading edge of an anode.

4. Apparatus according to claim 1, wherein the control means comprises means to regulate the size and/or duration of current applied to each of a plurality of separate regions of the target.

5. Apparatus according to claim 1, comprising control means operable to provide a material deposition layer on the target wherein different regions have predetermined reduction thicknesses.

6. Apparatus according to claim 1, comprising control means operable to provide a target with a uniform deposition thickness in selected regions.

7. Apparatus according to claim 1 wherein the direction means comprises a hollow, elongate body for the passage of electrolyte along the interior of the body.

8. Apparatus according to claim 1 comprising a single element anode.

9. Apparatus according to claim 1 comprising an anode formed of a plurality of generally parallel solid rods.

10. Apparatus according to claim 1 comprising an anode formed of a plurality of generally parallel tubes through which electrolyte passes.

11. A method of electroplating comprising the steps of:

a. directing a stream of electrolyte to a target region;

b. controlling the amount of reduction, and/or rate thereof, of ions in selected regions of the target, c. measuring the current flowing to said target region;

d. controlling the current applied to said target region in dependence on an output of the measurement step; and e. swirling said electrolyte to enhance the creation of vortices upon impingement of the stream with the said regions and thereby increasing the ion reduction rate.

12. A method according to claim 11 comprising regulating the current applied to each of a plurality of separate regions of the target.

13. A method according to claim 11 comprising regulating the size and/or duration of current applied to each of a plurality of separate regions of the target.

14. A method according to claim 11 comprising measuring the current flowing to a region of the target and controlling the current applied to that region in dependence on the output of the measurement step.

15. A method according to claim 11 comprising a controlling stage to provide a material deposition layer on the target of uniform thicknesses.

16. A method according to claim 15 wherein the controlling stage provides a target with a uniform deposition thickness in selected regions.

17. A method according to claim 15 wherein the controlling stage comprises controlling the current flow to each region so that the ion reduction rate for each region is independently varied.

18. A method according to claim 15 wherein the control stage comprises monitoring the current flow in all regions of the target.

19. A method according to claim 11 comprising a controlling step to provide a material deposition layer on the target wherein different regions have predetermined thickness.

20. A method according to claim 11 comprising the provision of a single element anode.

21. A method according to claim 11 comprising the provision of an anode formed of a plurality of generally parallel solid rods.

22. A method according to claim 11 comprising the provision of an anode formed of a plurality of generally parallel tubes along which electrolyte passes.

23. A method according to claim 11 wherein said step of swirling of the electrolyte includes swirling of the electrolyte in the vicinity of contact with said target region, thereby enhancing the creation of vortices before impingement of said stream with a substrate.

24. A method according to claim 23 wherein said step of creating or enhancing vortices is effected by a shaped body and/or an outlet through which said steam flows.

25. A method according to claim 11 wherein said step of swirling of the electrolyte includes positioning serrations in a leading edge of an anode.

26. A method of electroplating comprising the steps of:

a. providing an electrolyte channel which includes: a first wall, a second wall, a first electrode positioned between said walls, and a substrate contact area between said walls and above said first electrode;

b. positioning a second electrode adjacent to said substrate contact area;

c. flowing a stream of electrolyte through said electrolyte channel; and d. moving a substrate larger than said substrate contact area across said second electrode and said substrate contact area, such that only a portion of said substrate is in contract with said electrolyte at any given time.

27. The method according to claim 26, wherein said first electrode is an anode and said second electrode is a cathode.

28. The method according to claim 27, wherein said anode is provided with serrations upon a lead edge of said anode.

29. The method according to claim 26, wherein a swirling motion is caused in said electrolyte stream as it passes said substrate contact area.

* * * * *